US008974251B2

(12) United States Patent
Zong et al.

(10) Patent No.: US 8,974,251 B2
(45) Date of Patent: Mar. 10, 2015

(54) ELECTRICAL CONNECTOR ASSEMBLY AND METHOD OF MANUFACTURING THE SAME

(71) Applicant: Hon Hai Precision Industry Co., Ltd., New Taipei (TW)

(72) Inventors: Jun Zong, Kunshan (CN); Chi-Ming Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 63 days.

(21) Appl. No.: 13/919,754

(22) Filed: Jun. 17, 2013

(65) Prior Publication Data

US 2013/0337688 A1 Dec. 19, 2013

(30) Foreign Application Priority Data

Jun. 16, 2012 (CN) ..... 2012 1 0198302

(51) Int. Cl.
*H01R 24/00* (2011.01)

(52) U.S. Cl.
USPC ..... 439/660; 439/76.1; 439/77

(58) Field of Classification Search
USPC ..... 439/660, 67, 76.1, 77
See application file for complete search history.

(56) References Cited

U.S. PATENT DOCUMENTS

| | | | | |
|---|---|---|---|---|
| 7,651,379 | B1 * | 1/2010 | Wu | 439/660 |
| 7,654,831 | B1 * | 2/2010 | Wu | 439/76.1 |
| 7,938,669 | B2 * | 5/2011 | Li et al. | 439/352 |
| 8,506,331 | B2 * | 8/2013 | Wu | 439/607.18 |
| 8,562,369 | B2 * | 10/2013 | Wu | 439/345 |

FOREIGN PATENT DOCUMENTS

WO 2011150403 11/2011

* cited by examiner

*Primary Examiner* — Hien Vu
(74) *Attorney, Agent, or Firm* — Wei Te Chung; Ming Chieh Chang

(57) ABSTRACT

An electrical connector assembly comprises: a metallic housing having a receiving space extending along a longitudinal and two openings respectively formed on top and bottom surfaces thereof and communicated with the receiving space; a pair of flexible printed circuit boards (FPCs) received into the receiving space and arranged in a back-to-back manner. Each of the FPC defines a protuberant portion extending into the corresponding opening. And each of the protuberant portion has a plurality of contacts formed on one side thereof and communicated with an exterior. A pair of supporting pieces are received into the receiving space and attached to another side of the protuberant portion. And a spacer is received into the receiving space and sandwiched between the pair of flexible printed circuit boards and supporting pieces.

12 Claims, 5 Drawing Sheets

ELECTRICAL CONNECTOR ASSEMBLY AND METHOD OF MANUFACTURING THE SAME

FIELD OF THE INVENTION

The present invention generally relates to an electrical connector assembly, more specifically to an electrical connector assembly for transmitting power and data signal.

DESCRIPTION OF PRIOR ART

PCT Pat. Pub. No. WO2011150403 published to GOLKO etc. on Nov. 1, 2011 discloses a plug connector. Please refer to FIGS. 20A-22H, the plug connector comprises a tab having a grounding ring, two flex circuit with flex contacts received into the grounding ring, a dielectric overmold formed around the contacts and formed with the metallic housing, an inner jacket formed on a rear end of the tab, a cable bundle electrically connected to a rear end of the two flex circuit and a body formed around the inner jacket. It should be noted that the plug connector has complicated structure and is difficult to manufacture. Please refer to FIG. 21, the manufacturing process of the plug connector comprises many assembling steps and some steps are difficult to achieve. For example, an overmold is difficult to form around the contacts and will overflow to top and bottom surface of the grounding ring result in defective products. Thus, the plug connector will not be used or not be worked in a normal state.

An improved electrical connector assembly overcoming shortages of existing technology is needed.

SUMMARY OF THE INVENTION

Accordingly, an object of the present invention is to provide an electrical connector assembly having a simple structure.

In order to achieve the above-mentioned object, an electrical connector assembly comprises: a metallic housing having a receiving space extending along a longitudinal and two openings respectively formed on top and bottom surfaces thereof and communicated with the receiving space; a pair of flexible printed circuit boards (FPCs) received into the receiving space and arranged in a back-to-back manner. Each of the FPC defines a protuberant portion extending into the corresponding opening. And each of the protuberant portion has a plurality of contacts formed on one side thereof and communicated with an exterior. A pair of supporting pieces are received into the receiving space and attached to another side of the protuberant portion. And, a spacer is received into the receiving space and sandwiched between the pair of flexible printed circuit boards and supporting pieces.

Accordingly, another object of the present invention is to provide a method of manufacturing the electrical connector assembly with high efficiency and accuracy.

In order to achieve the above-mentioned object, a method of manufacturing an electrical connector assembly, comprises the steps of: providing a metallic housing having a receiving space extending forwardly from a rear surface thereof, and two openings formed on a top and bottom surfaces thereof and communicated with the receiving space; providing two reinforcement pieces, each of the reinforcement defining a protruding portion and a through hole throughout top and bottom surfaces of the protruding portion; assembling the two reinforcement pieces to the metallic housing, the two protruding portions respectively extended into the two openings; providing two flexible printed circuit boards (FPCs) arranged in a back-to-back manner, each of the FPC defining a protuberant portion passing through the through hole and extended into the opening, each of protuberant portion defining a plurality of contacts formed thereon; providing two supporting pieces; assembling the two supporting pieces to the two protuberant portions; providing a spacer; and inserting the spacer into the receiving space, the spacer sandwiched between two FPCs and two supporting pieces.

Other objects, features and advantages of the invention will be apparent from the following detailed description taken in connection with the accompanying drawings.

DETAILED DESCRIPTION OF PREFERRED EMBODIMENTS

Figure 1:
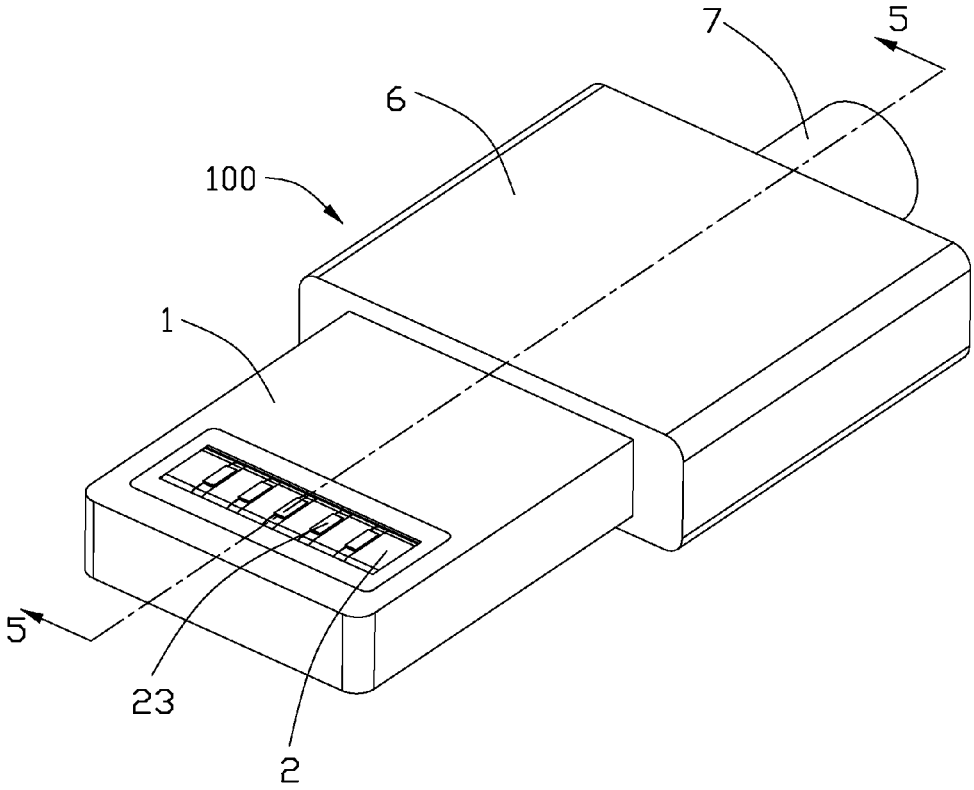
FIG. 1 is a perspective view of an electrical connector assembly in accordance with the present invention.

Reference will now be made to the drawing figures to describe the present invention in detail.

Figure 2:
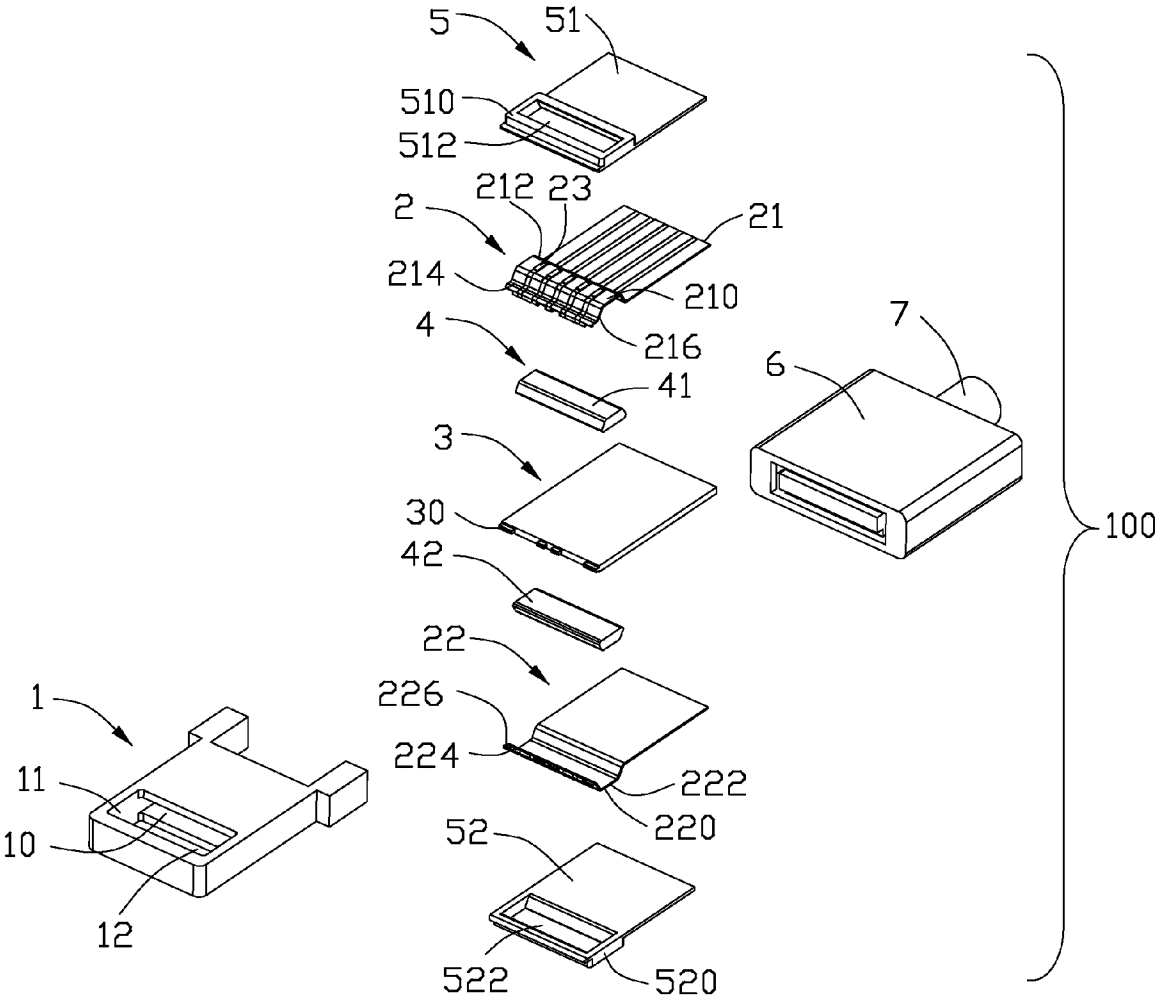
FIG. 2 is an exploded, perspective view of FIG. 1.
Figure 3:
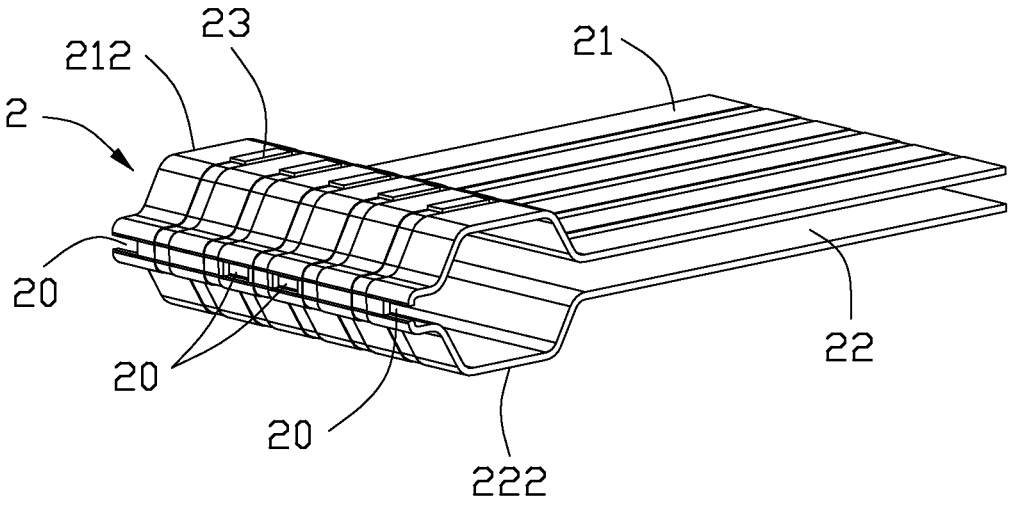
FIG. 3 is an assembled, perspective view of an upper and a lower FPCs in the electrical connector assembly shown in FIG. 1.
Figure 4:
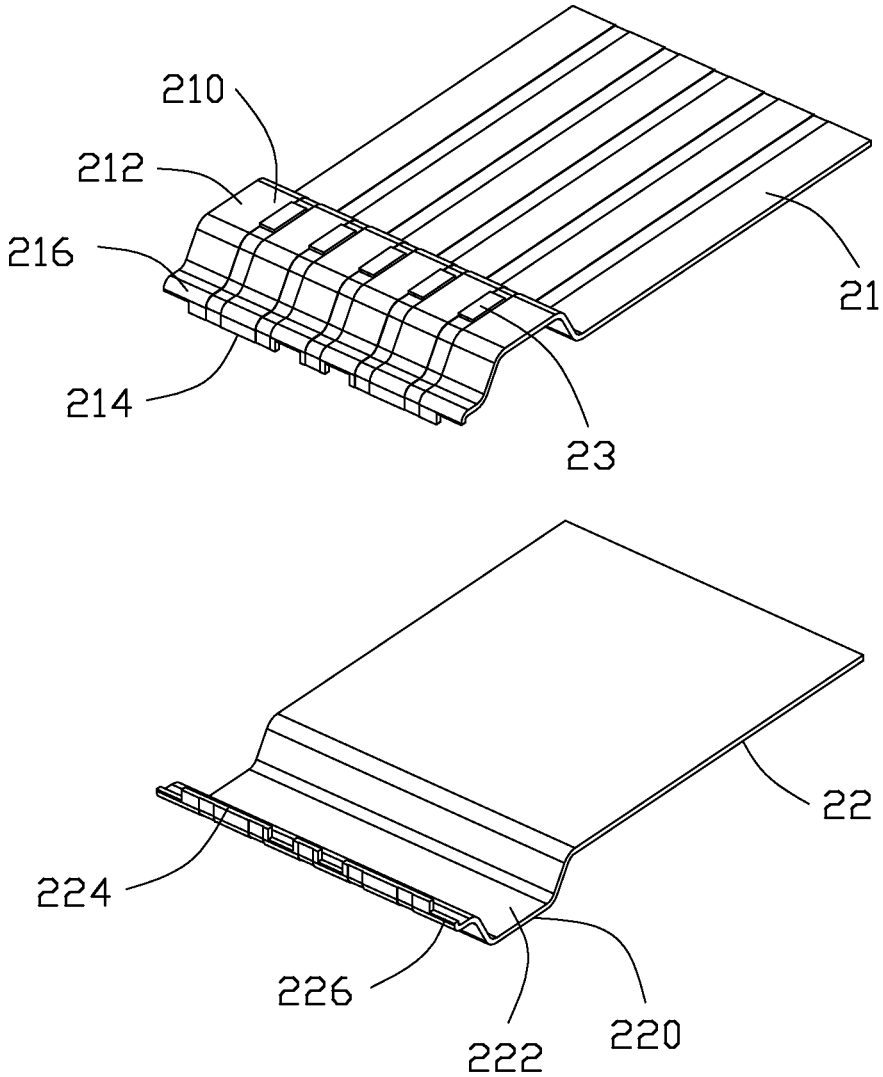
FIG. 4 is an exploded, perspective view of the upper and a lower FPCs shown in FIG. 3.

FIG. 1 illustrate perspective view of an electrical connector assembly 100 made in accordance with the present invention. Referring to FIG. 2 and in conjunction with FIG. 5, the electrical connector assembly 100 comprises a metallic housing 1 having a receiving space 10 extending forwardly from a rear surface thereof, two flexible printed circuit boards (FPCs) 2 received into the metallic housing 1 along a rear-to-front direction, a cable 7 electrically and mechanically connected to two rear ends of the two FPCs 2 and an insulative cover 6 surrounding a rear end of the metallic housing 1 and a front end of the cable 7 through an overmolding process.

Referring to FIGS. 1 to 2, the metallic housing 1 is structured in a rectangular shape and defines a top and bottom openings 11, 12 respectively formed on a top and bottom surfaces thereof and communicated with the receiving space 10.

Referring to FIGS. 2 to 5, the two flexible printed circuit boards (FPCs) 2 comprises an upper FPC 21 and a lower FPC 22 arranged in a back-to-back manner and spaced apart with each other. The upper and lower FPCs 21, 22 respectively defines a plurality of contacts 23 integratively formed on a top surface 210, 220 thereof. The upper and lower FPCs 21, 22 respectively defines a protuberant portion 212, 222 extending into the two openings 11, 12 and a front portion 216, 226 extending forwardly respectively from the protuberant portion 212, 222. Actually, the plurality of contacts 23 are respectively formed on the corresponding protuberant portions 212, 222 of the upper and lower FPCs 21, 22. The two front portions 216, 226 respectively a vertical free end 214, 224 mechanically connected with each other by glue or adhesive tape, not electrically connected with each other. In alternative embodiment, two flexible printed circuit boards 2 also can be formed by a single flexible printed circuit board through bending process. A plurality of cutouts 20 are formed between two vertical free ends 214, 224 when the two vertical free ends 214, 224 of the two FPCs 21, 22 are connected with each other.

Figure 5:
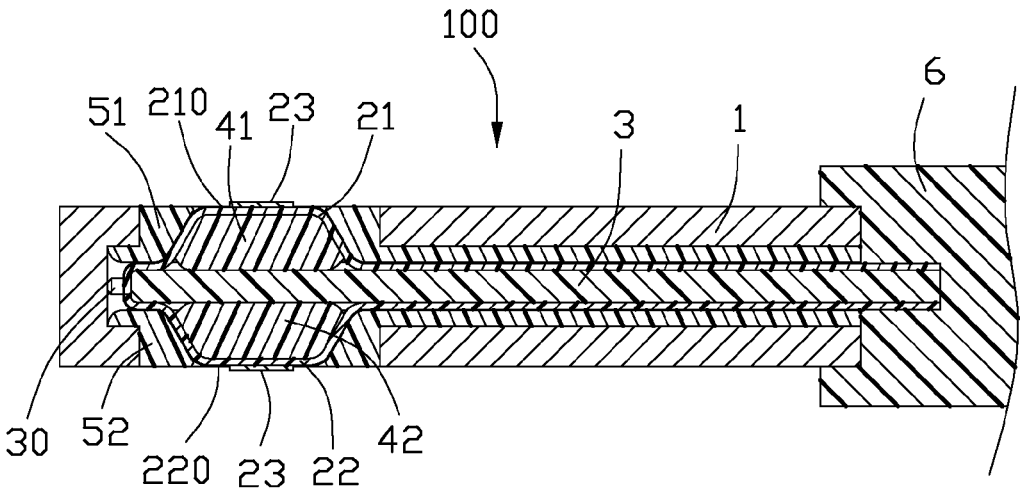
FIG. 5 is a cross-section view take along line 5-5 of FIG. 1.

Referring to FIG. 2 and in conjunction with FIG. 5, the electrical connector assembly 100 further comprises a spacer 3 received into the metallic housing 1 and sandwiched between the upper and lower FPCs 21, 22. The spacer 3 is structured in a flat shape and defines a plurality of protrusions 30 formed on a front end thereof and passed through the corresponding cutouts 20 of the two FPCs 2. Thus, the spacer 3 and the FPCs 2 are engaged with each other. In should be noted that two receiving rooms (not figured) are formed between two protuberant portions 212, 222 and the spacer 3 for receiving two supporting pieces 4.

Referring to FIG. 2 and in conjunction with FIG. 5, the electrical connector assembly 100 further comprises supporting piece 4 sandwiched between the two FPCs 2 and the spacer 3. The supporting piece 4 comprises an upper supporting piece 41 sandwiched between the protuberant portion 212 of the upper FPC 21 and the spacer 3, and a lower supporting piece 42 sandwiched between the protuberant portion 222 of the lower FPC 22 and the spacer 3.

Referring to FIG. 2 and in conjunction with FIG. 5, the electrical connector assembly 100 further comprises reinforcement piece 5 sandwiched between the two FPCs 2 and the metallic housing 1. The reinforcement piece 5 comprises an upper reinforcement piece 51 sandwiched between the upper FPC 21 and the metallic housing 1, and a lower reinforcement piece 52 sandwiched between the lower FPC 22 and the metallic housing 1. The upper and lower reinforcement pieces 51, 52 respectively defines a protruding portion 510, 520 received into the openings 11, 12. The upper and lower reinforcements 51, 52 respectively defines a through hole 512, 522 throughout top and bottom surfaces thereof for for receiving a portion of the protuberant portion 212, 222 of the upper and lower FPCs 21, 22.

Referring to FIGS. 1 to 5, the manufacturing process of the electrical connector assembly 100 made in according to the present invention starts from assembling the upper and lower FPCs 21, 22 together. The two FPCs 21, 22 are arranged in a back-to-back manner. Two free ends 214, 224 of the two FPCs 21, 22 are preliminary engaged with each other by glue or adhesive tape.

Then, assemble the two supporting pieces 41, 42 respectively to the upper and lower FPCs 21, 22. The upper and lower supporting pieces 41, 42 are assembled to a bottom surface of the upper and lower FPCs 21, 22, and respectively preliminary positioned to the upper and lower FPCs 21, 22 by glue.

Then, insert the two reinforcement pieces 51, 52 into the receiving space 10 of the metallic housing 1. The protruding portions 510, 520 of the two reinforcement pieces 51, 52 are extended into the two openings 11, 12 of the metallic housing 1. The two reinforcement pieces 51, 52 are preliminary positioned with the metallic housing 1 through glue.

Then, insert the upper and lower FPCs 21, 22 with two supporting pieces 41, 42 together to the receiving space 10 of the metallic housing 1. Thus, a portion with contacts 23 of each of protuberant portions 212, 222 respectively extends to an exterior of the metallic housing 1 through the through holes 512, 522.

Then, insert the spacer 3 into the metallic housing 1. The spacer 3 is sandwiched between the upper and lower FPCs 21, 22 and the upper and lower supporting pieces 41, 42. The plurality of protrusions 30 of the spacer 3 pass through the corresponding cutouts 20 of a connection area of the upper and lower FPCs 21, 22.

Finally, solder the cable 7 to a rear end of the upper and lower FPCs 21, 22. And assemble the cover 6 to a rear end of the housing 1 and a front end of the cable 7.

After the above assembling steps, the entire process of manufacturing of the electrical connector assembly 100 is finished. Actually, the electrical connector assembly 100 has simple structure and is easily to manufacture. Thus, the manufacturing cost of the electrical connector assembly 100 is lower. And, a method of manufacturing the electrical connector assembly 100 with high efficiency and accuracy.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly comprising:

a metallic housing having a receiving space extending along a longitudinal and two openings respectively formed on top and bottom surfaces thereof and communicated with the receiving space;

a pair of flexible printed circuit boards (FPCs) received into the receiving space and arranged in a back-to-back manner, each of the FPC defining a protuberant portion at one end and extending into the corresponding opening, and each of the protuberant portion having a plurality of contacts formed on one side thereof and communicated with an exterior;

a pair of supporting pieces received into the receiving space and attached to another side of the protuberant portion; and a spacer received into the receiving space and sandwiched between the pair of flexible printed circuit boards and supporting pieces;

wherein the electrical connector assembly further comprises a pair of reinforcement pieces received into the receiving space and respectively sandwiched between the metallic housing and the pair of FPCs;

wherein the pair of PFCs respectively has a front end connected with each other; and wherein a plurality of cutouts are formed between two front ends of the pair of FPCs, the spacer defines a plurality of protrusions formed on a front end thereof and passed through the corresponding cutouts.

2. The electrical connector assembly as recited in claim 1, wherein each of the reinforcement piece defines a protruding portion received into the opening of the metallic housing.

3. The electrical connector assembly as recited in claim 1, wherein the electrical connector assembly further comprise a cable electrically connected to the pair of FPCs and a cover formed on a rear end of the metallic housing and a front end of the cable.

4. A method of manufacturing an electrical connector assembly, comprising the steps of:

providing a metallic housing having a receiving space extending forwardly from a rear surface thereof, and two openings formed on a top and bottom surfaces thereof and communicated with the receiving space;

providing two reinforcement pieces, each of the reinforcement pieces defining a protruding portion and a through hole throughout top and bottom surfaces of the protruding portion;

assembling the two reinforcement pieces to the metallic housing, the two protruding portions respectively extended into the two openings;

providing two flexible printed circuit boards (FPCs) arranged in a back-to-back manner, each of the FPC defining a protuberant portion passing through the through hole and extended into the opening, each of protuberant portion defining a plurality of contacts formed thereon;

providing two supporting pieces;

assembling the two supporting pieces to the two protuberant portions;

providing a spacer;

inserting the spacer into the receiving space, the spacer sandwiched between two FPCs and two supporting pieces;

providing a cable;

soldering the cable to two rear ends of the FPCs; and overmolding a cover surrounding the a rear end of the metallic housing and a front end of the cable.

5. The method of manufacturing the electrical connector assembly as recited in claim 4, wherein a step of attaching two front ends of the two FPCs together after the step of providing two flexible printed circuit boards (FPCs).

6. The method of manufacturing the electrical connector assembly as recited in claim 5, wherein the two front ends of the two FPCs are connected with each other by glue.

7. The method of manufacturing the electrical connector assembly as recited in claim 5, wherein a plurality of cutouts are formed between the two front ends of the two FPCs, the spacer defines a plurality of protrusions passing through the corresponding cutouts.

8. An electrical connector comprising:

a pair of reinforcements commonly defining a receiving cavity extending along a horizontal plane defined by a front-to-back direction and a transverse direction perpendicular to each other;

at least one opening formed in one of said pair of reinforcements to communicate said receiving space with an exterior in a vertical direction perpendicular to both said front-to-back direction and said transverse direction;

at least one flexible printed circuit board (FPC) received in the receiving space with thereof a protuberant portion essentially flush with said one of the two opposite exterior surfaces and located in said opening;

a plurality of contacting conductive pads formed on an exterior surface of said protuberant portion facing the exterior outwardly;

a spacer received in said receiving cavity; and at least one supporting piece received in said opening and tightly sandwiched between the spacer and the protuberant portion in said vertical direction to provide support behind the protuberant portion in said vertical direction;

wherein remaining portions of said FPC are tightly sandwiched between said one of the pair of reinforcements and said spacer in said vertical direction;

wherein the electrical connector further comprises a housing enclosing said pair of reinforcements while exposing said opening;

wherein said housing is metallic; and wherein said one of the pair of reinforcements defines a raised portion, in said vertical direction, defining said opening and receiving said supporting piece.

9. The electrical connector as claimed in claim 8, wherein said supporting piece is discrete from the spacer.

10. The electrical connector as claimed in claim 8, further including a housing enclosing said pair of reinforcements while exposing said raising portion in said vertical direction.

11. The electrical connector as claimed in claim 10, wherein said housing defines an exterior surface flush with an exterior face of said raised portion.

12. The electrical connector as claimed in claim 11, wherein said housing horizontally surrounds said raised portion.

* * * * *